United States Patent [19]

Sonneborn et al.

[11] Patent Number: 4,752,714

[45] Date of Patent: Jun. 21, 1988

[54] DECELERATING AND SCAN EXPANSION LENS SYSTEM FOR ELECTRON DISCHARGE TUBE INCORPORATING A MICROCHANNEL PLATE

[75] Inventors: John H. Sonneborn, Portland; Kenneth W. Hawken, Aurora, both of Oreg.

[73] Assignee: Tektronix, Inc., Beaverton, Oreg.

[21] Appl. No.: 837,912

[22] Filed: Mar. 10, 1986

[51] Int. Cl.[4] ..... H01J 1/46; H01J 3/36; H01J 29/80

[52] U.S. Cl. ..... 313/429; 313/432; 313/449; 313/460; 313/103 CM

[58] Field of Search ..... 313/103 CM, 105 CM, 313/449, 528, 429, 432, 460

[56] References Cited

U.S. PATENT DOCUMENTS

| | | | |
|---|---|---|---|
| 3,376,447 | 4/1968 | Petit | 313/449 X |
| 4,511,822 | 4/1985 | Washington et al. | 313/105 CM X |
| 4,543,508 | 9/1985 | Saito | 313/449 X |

*Primary Examiner*—David K. Moore

*Assistant Examiner*—K. Wieder

*Attorney, Agent, or Firm*—John D. Winkelman; Paul S. Angello

[57] ABSTRACT

An electrostatic decelerating and scan expansion lens system (10) includes a mesh element (56) and operates in a cathode-ray tube (12) that incorporates a microchannel plate (24). The lens system is positioned downstream of the deflection structure (42 and 44) and provides linear magnification of the electron beam deflection angle. The mesh element is formed in the shape of a convex surface as viewed in the direction of travel of the electron beam (40) to provide a field with equipotential surfaces (100) of decreasing potential in the direction of electron beam travel. Secondary emission electrons generated by the mesh element as it intercepts the electron beam, are therefore, directed back toward the lens system and not toward the microchannel plate. Only the beam electrons strike the microchannel plate, which provides on the phosphorescent display (20) an image of high brightness, free from spurious light patterns.

20 Claims, 3 Drawing Sheets

DECELERATING AND SCAN EXPANSION LENS SYSTEM FOR ELECTRON DISCHARGE TUBE INCORPORATING A MICROCHANNEL PLATE

TECHNICAL FIELD

This invention relates to post-deflection electrostatic electron lens systems in electron discharge tubes, and in particular, to a decelerating and scan expansion electron lens system for use in a cathode-ray tube (CRT) that incorporates a microchannel plate adjacent its phosphorescent display screen. The lens system of the invention provides linear magnification of the electron beam deflection angle and prevents the propagation of secondary emission electrons toward the display screen.

BACKGROUND OF THE INVENTION

Post-deflection electrostatic electron lens systems incorporated in conventional cathode-ray tubes typically perform two distinct functions. First, the lens system magnifies the amount of the electron beam deflection produced by the deflection structure of the CRT to provide an image of desired size on the display screen. Second, the lens system accelerates the electrons in the electron beam by developing a high intensity electric field between the exit end of the lens system and the display screen. This increases the energy of the electrons and thereby produces a brighter image on the phosphorescent screen.

Certain cathode-ray tubes are provided with microchannel plates adjacent their display screens to obtain greatly enhanced visual and photographic writing speeds. Such a CRT is used, for example, in the Model 7104, 1 GHz oscilloscope manufactured by Tektronix, Inc. A microchannel plate, or MCP, is a two-dimensional array of individual channel electron multipliers, which generate from 1,000 to 10,000 or more electrons for each input electron received. Located with its output face near the inner surface of the phosphorescent display screen of the CRT, the MCP multiplies beam electrons striking its input face to produce a trace of greatly increased brightness on the display screen. Among other advantages, this enables the viewing of extremely fast traces that otherwise would not be visible on the display screen of the CRT.

Mesh lenses are commonly used in post-deflection acceleration (PDA) cathode-ray tubes to increase deflection sensitivity and to prevent the penetration of high voltage accelerating fields into the low voltage deflection regions of such tubes. A conventional accelerating mesh lens would be unsuitable, however, for use in a cathode-ray tube having a microchannel plate. The reason is that the lens mesh intercepts some of the electrons exiting the deflection structure and creates additional electrons by way of secondary emission. The secondary emission electrons are accelerated toward the phosphorescent screen and produce spurious light patterns, typically in the form of a halo, and degrade the display contrast. The use of a microchannel plate in association with an accelerating mesh lens would, therefore, function to multiply the number of secondary emission electrons and thereby further degrade the display contrast.

To prevent the creation and thereby the multiplication of secondary emission electrons, it would be necessary to employ a "meshless" scan expansion lens, such as the rectangular box-shaped lens that is the subject of U.S. Pat. No. 4,124,128 of Odenthal, or the interdigitated tubular quadrupole lens shown and described in U.S. Pat. No. 4,188,563 of Janko. The scan expansion lenses of Odenthal and Janko do not employ mesh elements and, as a consequence, do not create secondary emission electrons. Both of these lenses suffer, however, from the disadvantages of being difficult to manufacture and align.

SUMMARY OF THE INVENTION

An object of this invention is, therefore, to provide a post-deflection electrostatic electron lens system that is operable in association with a microchannel plate in a cathode-ray tube to provide an image with high brightness.

Another object of this invention is to provide such a lens system that includes a mesh element, but which does not produce spurious light images from the production of secondary emission electrons.

A further object of this invention is to provide such a lens system that accomplishes strong deflection magnification of an electron beam and a bright, distortion-free image on the phosphorescent screen of the tube.

Still another object of this invention is to provide such a lens system that is of a relatively simple design and requires minimal adjustment.

The present invention is directed to an electrostatic decelerating and scan expansion lens system for use in an electron discharge tube, such as a cathode-ray tube. The cathode-ray tube includes an electron gun that produces a beam of electrons directed along a beam axis in the tube and that has a deflection structure for deflecting the beam. The lens system of the invention is positioned downstream of the deflection structure along the beam axis and includes first and second electrode structures. The first electrode structure includes a tubular metal electrode of cylindrical shape through which the beam of electrons propagates. The cylindrical electrode is biased to a potential at or near the average potential applied to the deflection structure. The second electrode structure includes a metal mesh element that is positioned adjacent the output end of the first electrode structure. The mesh element is formed to have a convex surface of rotationally symmetric shape as viewed in the direction of travel of the beam of electrons. The mesh electrode structure is biased to a strongly negative potential relative to that applied to the first electrode structure.

The potential difference between the first and second electrode structures creates an electrostatic field with equipotential surfaces contained generally within the cylinder of the first electrode structure to create force lines that point in a direction opposite to the propagation direction of the beam electrons but outwardly of the beam axis. This field serves to magnify the deflection angle produced by the deflection structure. The directions of the force lines are characteristic of a divergent electron lens and cause the secondary emission electrons produced when the beam electrons intercept the mesh element to move back toward the inner cylindrical surface of the first electrode structure. This prevents the propagation of secondary emission electrons toward a microchannel plate, which is positioned adjacent the phosphorescent display screen of the cathode-ray tube.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figure 1:
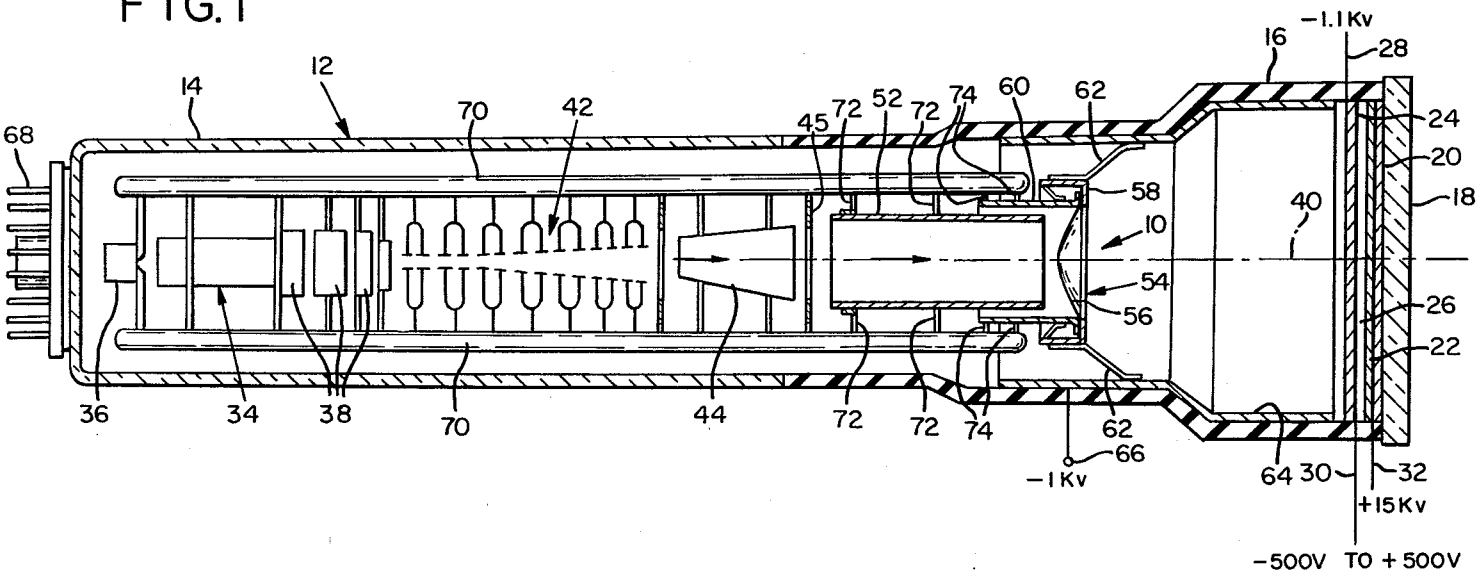
FIG. 1 is a schematic longitudinal sectional view of a cathode-ray tube incorporating the postdeflection decelerating and scan expansion lens system of the present invention.
Figure 2:
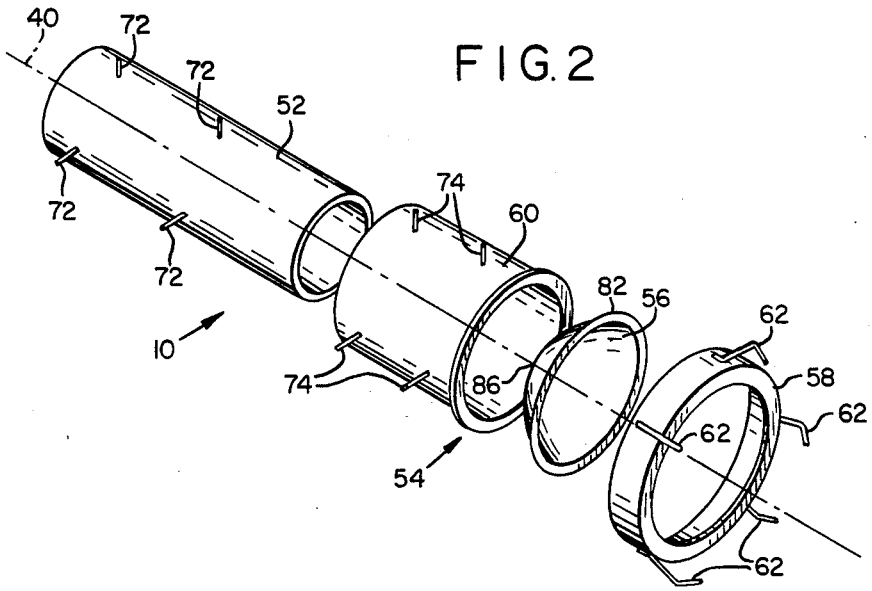
FIG. 2 is an exploded view showing the components of the lens system of the invention in the cathode-ray tube of FIG. 1.

With reference to FIG. 1, an electron beam decelerating and scan expansion lens system 10 designed in accordance with the present invention is contained within the evacuated envelope of a cathode-ray tube 12 for an oscilloscope. The envelope includes a tubular glass neck 14, ceramic funnel 16, and transparent glass face plate 18 sealed together by devitrified glass seals as taught in U.S. Pat. No. 3,207,936 of Wilbanks, et al. A layer 20 of a phosphor material, such as, for example, P-31 phosphor, is coated on the inner surface of face plate 18 to form the display screen for the cathode-ray tube. An electron transparent aluminum film 22 is deposited by evaporation on the inner surface of layer 20 of the phosphor material to provide a high-voltage electrode. Film 22 attracts the electrons emitted from the output face or side of an electron multiplying means or microchannel plate 24 after the electron beam strikes its input face. Microchannel plate 24 is spaced a short distance from film 22, herein about three millimeters.

Microchannel plate 24 is an assembled structure of microscopic conductive glass channels. The channels are parallel to one another, each channel having an entrance on one major surface and an exit on the other major surface. A potential is applied across the major surfaces, i.e., across the length of the channels, of microchannel plate 24. A potential difference of between +600 volts and +1.6 kv is applied to feedthrough pins 28 and 30, which are electrically connected to the respective entrance and exit surfaces of microchannel plate 24. Aluminum film 22 receives a voltage of about +15 kv on feedthrough pin 32. This positive voltage of high magnitude accelerates the electrons exiting microchannel plate 24 toward display screen 20.

An electron gun 34, which includes a cathode 36 and focusing anodes 38, is supported inside neck 14 at the end of the tube opposite display screen 20 to produce a beam of electrons directed generally along a beam axis 40 toward the display screen. Beam axis 40 is generally coincident with the central longitudinal axis of the tube. A DC voltage source of approximately −2 kv is connected to cathode 36, and the electron beam emitted from the cathode is accelerated toward focusing anodes 38, which are connected to ground potential. A grid (not shown) is biased to a more negative voltage of about −2.1 kv than the cathode to control the number of electrons propagating to focusing anodes 38 and thereby vary the intensity of the electron beam.

The electron beam strikes microchannel plate 24 after passing through a suitable deflection structure. The deflection structure herein includes a vertical deflection assembly 42, preferably of the type described in U.S. Pat. No. 4,207,492 of Tomison, et al., and a pair of horizontal deflection plates 44 (one shown). Deflection assembly 42 deflects the beam in the vertical direction in response to vertical deflection signals applied to its upper and lower deflection members. Deflection plates 44 deflect the beam in the horizontal direction in response to a horizontal deflection signal, which is the ramp voltage output of a conventional time-base sweep circuit.

After passing through vertical deflection assembly 42 and horizontal deflection plates 44, the electron beam passes through the aperture of a geometry correction electrode 45 of octupole shape and then toward MCP 24 through a field of decreasing potential produced by lens system 10. This potential decelerates the beam electrons and causes them to strike the microchannel plate at a reduced velocity. The postdeflection electric field is produced by the cooperation between a cylindrical first electrode, or cylinder structure 52 and a mesh second electrode structure 54 of lens system 10. Mesh electrode structure 54 comprises a mesh element 56 that is supported on a metal ring 58 which is attached to the forward end of a support cylinder 60. Mesh element 56 is constructed of nickel and is formed in the shape of a convex surface as viewed in the direction of propagation of the electron beam.

Plural spring contacts 62 attached to the periphery of metal ring 58 engage a conductive wall coating 64 on the inner surface of ceramic funnel 16. The mesh electrode structure 54 is maintained at the potential applied to wall coating 64 by way of feedthrough pin 66, which potential is about −1 kv. Cylindrical electrode 52 is electrically connected by way of base pins 68 to the average potential of deflection plates 44, which potential is approximately ground. These potentials create, therefore, a field-free region from the output ends of deflection plates 44 to approximately the middle of the inside of electrode structure 54. An electric field is developed in the region from approximately the middle of the inside of electrode structure 52 to mesh element 56. The electric field is of a character that produces curved equipotential surfaces of increasing radii in the direction opposite to the direction of travel of the beam electrons. An electric field of this character produces equipotential surfaces of decreasing potential, which decelerates the electrons as they pass through lens 10 toward microchannel plate 24 as will be further described below.

The various electrodes of electron gun 34 are connected to external circuitry through base pins 68. Four glass mounting rods 70 provide the support for electron gun 34, vertical deflection assembly 42, horizontal deflection plates 44, and lens system 10.

With reference to FIGS. 1–4, electrode 52 is an elongate tube of cylindrical shape. Support cylinder 60 of electrode structure 54 is coaxially aligned with and overlaps a portion of the output end of cylinder 52. Mounting studs 72 and 74 extend radially outwardly from cylinders 52 and 60, respectively, and extend into the four glass mounting rods 70 (FIG. 4) to provide support for electrode 52 and electrode structure 54 so that their central longitudinal axes are aligned coincident with beam axis 40.

Figure 3:
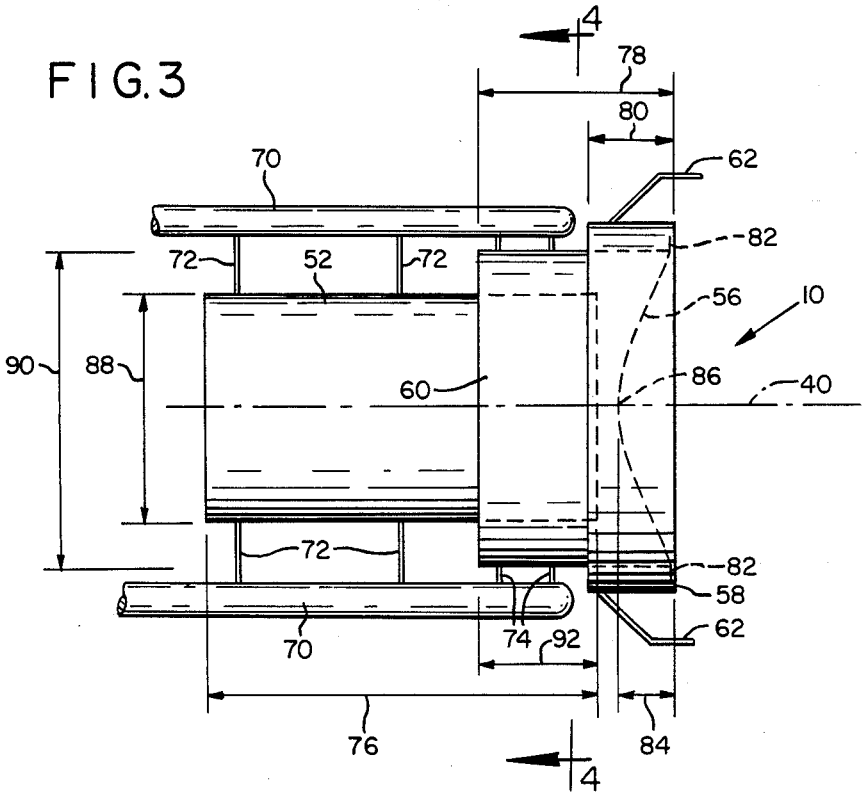
FIG. 3 is an enlarged side elevation view of the lens system of FIGS. 1 and 2, with portions of the electrodes shown in phantom.
Figure 4:
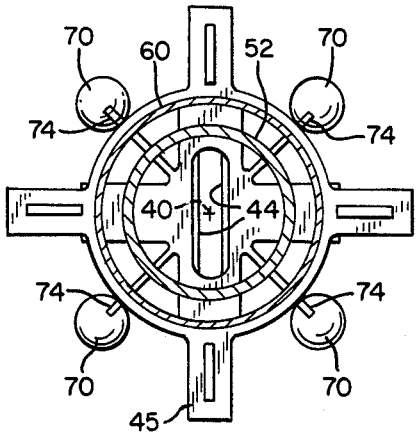
FIG. 4 if is a vertical section view taken along line 4—4 of FIG. 3.

With particular reference to FIG. 3, in the preferred embodiment, cylinder 52 has a total length 76 of 4 centimeters. Support cylinder 60 has a length 78 of 1.9 centimeters, of which a length 80 of 0.8 centimeters is covered by metal ring 58. Mesh element 56 has an annular rim 82 extending around the periphery of its open end and fits between cylinder 60 and metal ring 58 to hold mesh element 56 in place. Mesh element 56 has a hyperbolic contour of rotationally symmetric shape and has a distance 84 of 0.55 centimeter along a line measured from the plane defined by its rim 82 to its apex 86. Cylinder 52 has an outer diameter 88 of 2.2 centimeters and an inner diameter of 2.05 centimeters, and cylinder 60 has an outer diameter 90 of 2.9 centimeters and an inner diameter of 2.75 centimeters.

Changing the distance 92 that support electrode 60 overlaps cylinder 52 provides a geometry correction control for the image. In the preferred embodiment, a distance 92 of 0.8 centimeter provides corrected geometry of the image.

Figure 5:
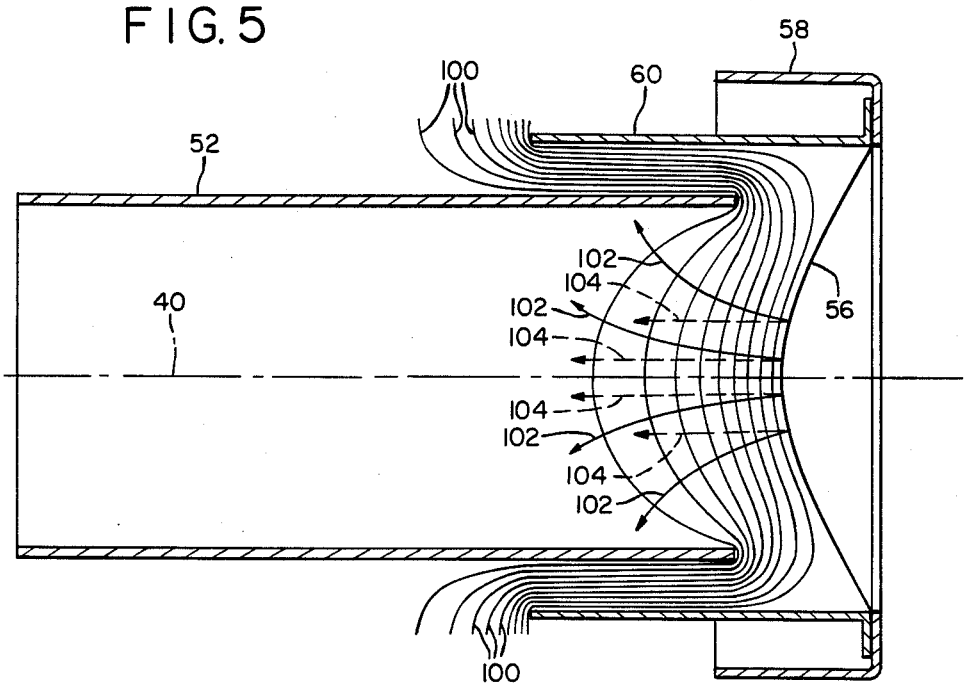
FIG. 5 is a diagram showing the equipotential surfaces and lines of force of the electric field developed by the lens system of the invention in the cathode-ray tube of FIG. 1.

With reference to FIG. 5, the ground potential applied to electrode 52 and the −1 kv applied to electrode structure 54 develop an electric field within the interior of electrode 52. This electric field can be characterized as a family of equipotential surfaces 100 of decreasing magnitude in the direction opposite to the direction of travel of the electron beam. The force lines 102 associated with the electric field act upon the beam electrons moving through the field. Force lines 102 extend in a direction normal to the equipotential surfaces and have axial components 104 projected onto beam axis 40 in the direction of increasing potential, i.e., toward the inner surface of cylinder 52.

Mesh element 56 intercepts the beam electrons that exit deflection plates 44. Since it is a conductor, mesh element 56 generates secondary emission electrons when the electron beam strikes it. Axial components 104 of force lines 102 direct the secondary emission electrons back toward the inner surface of cylinder 52 so that they do not move toward microchannel plate 24. This prevents the production of spurious light patterns on phosphorescent screen 20, which patterns would result from the forward propagation of secondary emission electrons. Force lines 102 decelerate the beam electrons, which drift toward microchannel plate 24 in an essentially field-free region between electron lens 10 and microchannel plate 24.

Since it is curved in both planes normal to the electron beam axis, mesh element 56 develops equipotential surfaces 100 that influence the electron beam propagation in two directions. The directions of force lines 102 create, therefore, a divergent lens which causes a linear expansion of the deflection angle in both the horizontal and vertical directions. The beam electrons exiting mesh element 56 move toward the target structure, which includes microchannel plate 24 and display screen 20. These electrons strike microchannel plate 24, which functions as an input member of the target structure. Microchannel plate 24 has a relatively low potential of between about +600 volts to +1.6 kilovolts applied across the channels. The electrons exiting microchannel plate 24 are accelerated toward aluminum film 22, which has a relatively high potential of about +15 kilovolts. The result is an image with enhanced brightness, free from spurious light patterns.

It will be obvious to those having skill in the art that many changes may be made in the above-described details of the preferred embodiment of the present invention. The scope of the present invention should, therefore, be determined only by the following claims.

We claim:

1. A deceleration and scan expansion electron lens positioned between deflection structure and a target structure of an electron discharge tube, comprising:

a tubular electrode structure which receives an electron beam exiting the deflection structure and through which the electron beam travels toward the target structure;

a mesh electrode structure positioned to intercept the electron beam after it passes through the tubular electrode structure, the mesh electrode structure including a mesh element formed in the shape of a convex surface as viewed in the direction of travel of the electron beam; and means for applying a bias potential between the tubular electrode structure and the mesh electrode structure, the mesh electrode structure having a negative potential relative to that of the tubular electrode structure, thereby to expand the deflection provided by the deflection structure and decelerate the beam electrons as they travel through the tubular electrode structure toward the target structure.

2. The electron lens of claim 1 in which the mesh element is of rotationally symmetric shape.

3. A cathode-ray tube, comprising:

means for producing a beam of electrons directed along a beam axis in the tube toward a remote display screen;

deflection means for deflecting the beam relative to the beam axis;

electron multiplying means positioned adjacent the screen to receive the electron beam and provide an increased number of electrons to the display screen and thereby enhance display image brightness; and a decelerating and scan expansion electron lens positioned downstream of the deflection means and upstream of the electron multiplying means to magnify the amount of electron beam deflection produced by the deflection means and to decelerate the electrons in the deflected electron beam to prevent the movement of secondary emission electrons toward the electron multiplying means and thereby prevent the production of spurious light image patterns on the screen caused by such electrons.

4. The tube of claim 3 in which the electron lens develops an electric field through which the beam of electrons travels and comprises a mesh element formed in the shape of a convex surface as viewed in the direction of travel of the beam of electrons.

5. The tube of claim 4 in which the electron lens develops a first electric field and in which there exists a region within the tube between the electron multiplying means and the electron lens, the region including a second electric field of substantially lower intensity than that of the first electric field.

6. The system of claim 5 in which the first electric field produces lines of force having axial components projected onto the beam axis in the direction opposite to that of the direction of travel of the beam of electrons to prevent the attraction of secondary emission electrons dislodged from the mesh element toward the screen.

7. The system of claim 4 in which the mesh element is of rotationally symmetric shape.

8. The system of claim 3 in which the electron multiplying means comprises a microchannel plate.

9. In an electron discharge tube having an electron gun positioned at one end of the tube for producing a beam of electrons directed along a beam axis in the tube and deflection means for deflecting the electron beam to form an image, an electrostatic lens system positioned downstream of the deflection means along the beam axis and comprising:

a decelerating and scan expansion lens including a first electrode structure and a mesh electrode structure supported downstream of the first electrode structure, the first electrode structure and the mesh electrode structure cooperating to develop an electric field through which the beam of electrons travels, the electric field being of a character that linearly expands the electron beam deflection provided by the deflection structure and decelerates the beam electrons as they propagate through the electric field; and a target structure having an input member to which a potential is applied to produce an electric field of relatively low intensity that attracts the beam electrons but not secondary emission electrons dislodged from the mesh electrode.

10. The tube of claim 9 in which the first electrode structure comprises a first tubular electrode through which the beam of electrons propagates.

11. The tube of claim 10 in which the mesh electrode structure comprises a mesh element that is formed in the shape of a convex surface as viewed in the direction of movement of the beam of electrons and forms electric field lines that are contained substantially within the first tubular electrode.

12. The tube of claim 10 in which the mesh electrode structure comprises a second tubular electrode that is coaxially aligned with and overlaps a portion of the first tubular electrode by an amount that provides for corrected geometry of the image.

13. The tube of claim 12 in which each of the first and second tubular electrodes is of cylindrical shape.

14. The tube of claim 9 in which the input member of the target structure comprises an electron multiplier that increases the number of electrons striking the screen and thereby provides an image with high brightness.

15. The tube of claim 14 in which the electron multiplier comprises a microchannel plate.

16. A cathode-ray tube, comprising:

an image display screen comprising a layer of phosphorescent material;

an electron multiplier positioned adjacent the screen and including input means for receiving a beam of electrons and output means for providing an increased number of electrons to the screen;

means for producing a beam of electrons directed along an axis toward the input means of the electron multiplier;

deflection means for deflecting the beam away from the axis; and a divergent electron lens disposed intermediate the deflection means and the electron multiplier for increasing the amount of electron beam deflection produced by the deflection means, the lens including means for providing a decelerating electric field between the deflection means and the electron multiplier.

17. The cathode-ray tube of claim 16 in which the electron lens comprises a conductive mesh element disposed in the path of the beam.

18. The cathode-ray tube of claim 17 in which the electron lens comprises a first tubular electrode disposed in alignment with the axis and a second tubular electrode aligned coaxially with the first electrode, the second tubular electrode supporting the mesh element at one end thereof.

19. The cathode-ray tube of claim 18 in which the mesh element is maintained at a negative potential relative to that of the first tubular electrode.

20. The cathode-ray tube of claim 16 in which the electron multiplier comprises a microchannel plate.

* * * * *